US005090828A

United States Patent [19]

Shimura et al.

[11] Patent Number: 5,090,828

[45] Date of Patent: Feb. 25, 1992

[54] APPARATUS FOR REPLENISHING A DEPLETED INK SHEET

[75] Inventors: Hidetsugu Shimura; Hajime Kurihara, both of Nagano, Japan

[73] Assignee: Seiko Epson Corporation, Tokyo, Japan

[21] Appl. No.: 483,834

[22] Filed: Feb. 23, 1990

Related U.S. Application Data

[62] Division of Ser. No. 312,000, Feb. 17, 1989.

[30] Foreign Application Priority Data

Feb. 18, 1988 [JP] Japan ..... 63-36114
Feb. 18, 1988 [JP] Japan ..... 63-36116

[51] Int. Cl.[5] ..... B41J 31/16

[52] U.S. Cl. ..... 400/197; 400/201; 118/621; 101/DIG. 37; 427/14.1; 427/25; 427/141

[58] Field of Search ..... 400/202, 198, 201, 197, 400/196, 200, 199, 202.2, 202.4; 101/DIG. 37; 427/14.1, 25, 141; 118/677, 679, 620, 621; 346/140 R

[56] References Cited

U.S. PATENT DOCUMENTS 4,253,775 3/1981 Crooks et al. ..... 400/198
4,296,176 10/1981 Lennon et al. ..... 428/407
4,419,024 12/1983 Bowlds ..... 400/120
4,421,429 12/1983 Graham ..... 400/120
4,467,332 8/1984 Akutsu ..... 346/140 R
4,847,110 7/1989 Nakajima ..... 427/25
4,882,593 11/1989 Touma ..... 346/111
4,897,669 1/1990 Akutsu et al. ..... 346/76 PH
4,976,986 12/1990 Akutsu ..... 427/27

FOREIGN PATENT DOCUMENTS 126475 9/1980 Japan ..... 400/198
18284 2/1983 Japan ..... 400/198
82264 5/1983 Japan ..... 427/14.1
134778 8/1983 Japan ..... 400/201
155984 9/1983 Japan ..... 400/198
259485 12/1985 Japan ..... 400/198

*Primary Examiner*—Edgar S. Burr
*Assistant Examiner*—Eric P. Raciti
*Attorney, Agent, or Firm*—Blum Kaplan

[57] ABSTRACT

A method and apparatus for replenishing depleted portions of an ink sheet including a conductive ink layer on a dielectric layer wherein portions of ink have been transferred to a transfer medium. Conductive replacement ink material is supplied to the ink sheet and an electric charge is induced in the replacement ink and opposite charges are induced at an electrode on the opposite side of the dielectric layer. Replacement ink contacting the dielectric layer at the voids will adhere to the ink sheet, but charges in the replacement ink contacting the non-transcribed ink regions will flow to the conductive ink layer and will not adhere to the ink sheet.

31 Claims, 6 Drawing Sheets

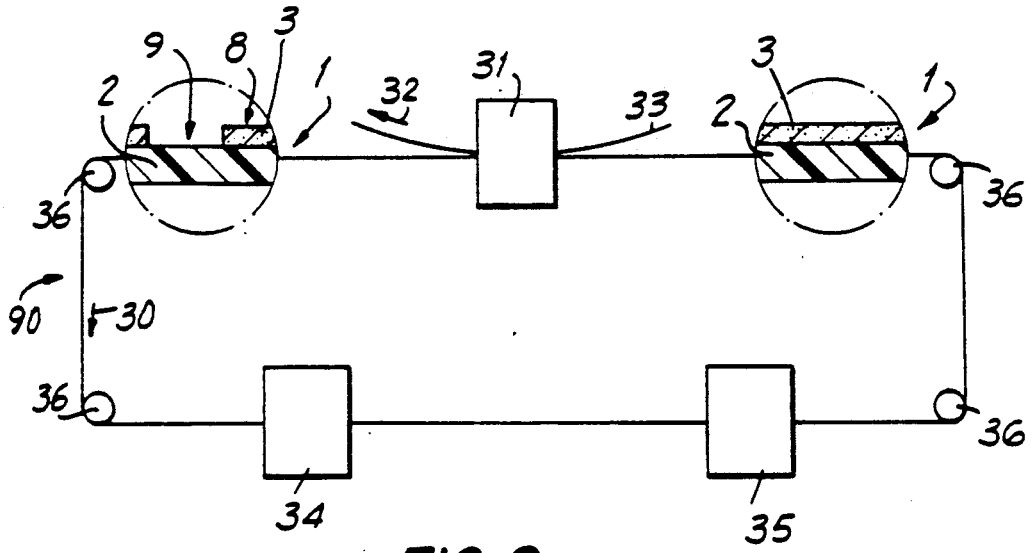
FIG. 9
FIG. 10
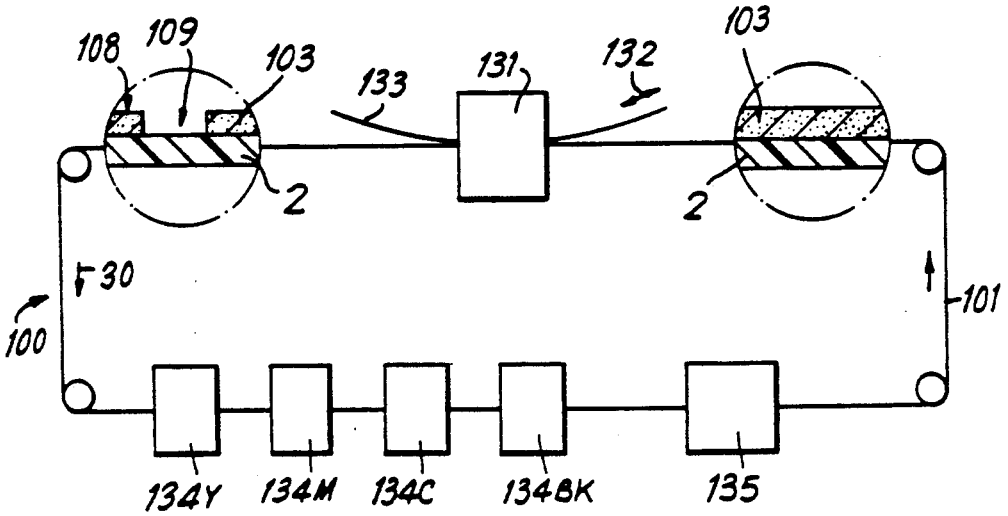

APPARATUS FOR REPLENISHING A DEPLETED INK SHEET

This is a division of application Ser. No. 07/312,000, filed Feb. 17, 1989.

BACKGROUND OF THE INVENTION

The invention relates generally to a reusable ink sheet for transferring information onto a recording medium and more particularly to a method and apparatus for replenishing the ink that is transferred from the ink sheet during printing.

Conventional ink sheet printing methods have drawbacks. Once a dot of ink is transferred from the ink sheet to a transfer medium, that portion of the ink sheet is no longer useable. Consequently, printing methods that utilize conventional ink transfer sheets are expensive and wasteful because of the need to continuously replace partially depleted ink transfer sheets.

A method for recoating the ink layer of an ink sheet is discussed in "A Color Thermal Transfer Printer With Recording Mechanism", SID '85 Digest, pp. 143–45. This method essentially involves providing an ink sheet in the form of an endless belt and continuously replacing the entire ink layer with fresh, melted ink from a storage container. The ink is allowed to cool and the replaced ink layer is ready for printing.

This method has certain disadvantages. Considerable time is necessary for a warm-up while the ink in the storage container is melted. Further, a large amount of electricity is needed to maintain the replacement ink in a molten state. This method is inherently inefficient in that rather than replenishing only selected portions from which the ink had been transferred the entire ink layer is continuously replaced.

Apparatuses for performing this method can be expensive and complicated. Mechanisms are needed to insure that the replenished ink layer is of uniform thickness. Additional mechanisms are required to eliminate molten ink from the ink sheet after the printer is turned off. Such an apparatus would be large and require considerable maintenance for proper continued operation.

A method of replenishing an ink sheet that uses powdered ink is described in the U.S. Pat. No. 4,467,332 in which powdered ink is transferred from the surface of an electrode mainly to depleted recorded portions of the ink sheet. This method also has shortcomings. Powdered ink unintentionally adheres to unused portions of the ink sheet. Although the amount of ink adhering to the recorded and unrecorded portions of the ink layer can be controlled, distributions of electric potentials appear at interfaces between recorded portions and unrecorded portions of the ink layer. This phenomenon is referred to as the edge effect. Adhesion of the powdered ink in the vicinity of the interface is increased. This leads to an uneven layer of ink and problems occur when attempting to adjust the thickness of the regenerated ink layer.

Accordingly, it is desirable to develop an improved method and apparatus for replenishing an ink sheet which avoids the shortcomings of the prior art.

SUMMARY OF THE INVENTION

Generally speaking, in accordance with the invention, a method and apparatus is provided for replenishing depleted portions of an ink sheet, from which ink has been transferred to a transfer medium, without unintentionally supplying ink to undepleted non-recorded portions of the ink layer. To accomplish the foregoing, an ink sheet having a dielectric layer and a conductive ink layer disposed on the dielectric layer is provided. Replacement ink is supplied to the ink layer including the depleted recorded portions and a potential is applied across the ink sheet and the replacement ink which only adheres to the depleted portions of the ink sheet.

Accordingly, it is an object of the invention to provide an improved method and apparatus for replenishing depleted portions of an ink layer of an ink sheet.

Another object of the invention is to provide an improved apparatus and method for replenishing a depleted ink layer of an ink sheet that is less complex than conventional methods and apparatuses.

A further object of the invention is to provide a method and apparatus for replenishing depleted portions of an ink layer of an ink sheet in which the replenishing ink adheres only to the depleted portions and the resulting ink layer is uniform, smooth and highly reproducible.

Still another object of the invention is to provide an improved method and apparatus for replenishing depleted portions of an ink sheet so that when the replenished ink sheet is used for printing, the resulting images will have high quality and reproducibility.

Still other objects and advantages of the invention will in part be obvious and will in part be apparent from the specification and drawings.

The invention accordingly comprises the several steps and the relation of one or more of such steps with respect to each of the others, and the apparatus embodying features of construction, combinations of elements and arrangements of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 9 is a schematic view of an image transfer apparatus constructed in accordance with an embodiment of the invention;

FIG. 10 is a schematic view of a multi-color image transfer apparatus constructed in accordance with an embodiment of the invention;

DESCRIPTION OF THE PREFERRED EMBODIMENTS

Depleted portions of an ink layer of an ink sheet are replenished by selectively supplying replacement ink to the depleted portions from which ink has been printed and not to unrecorded portions of the ink layer. The resulting ink layer is uniform, smooth and highly reproducible.

Figure 1:
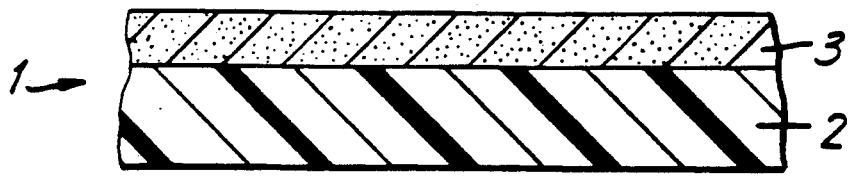
FIG. 1 is a sectional view of a reusable ink sheet constructed in accordance with an embodiment of the invention.
Figure 2:
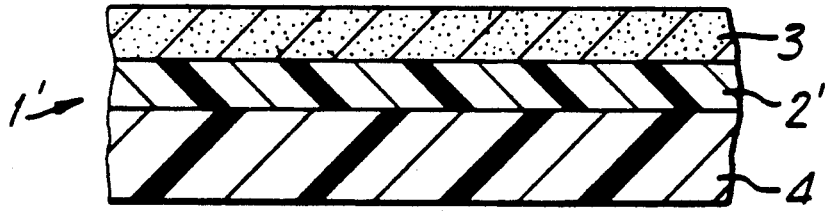
FIG. 2 is a sectional view of a reusable ink sheet constructed in accordance with another embodiment of the invention.
Figure 3:
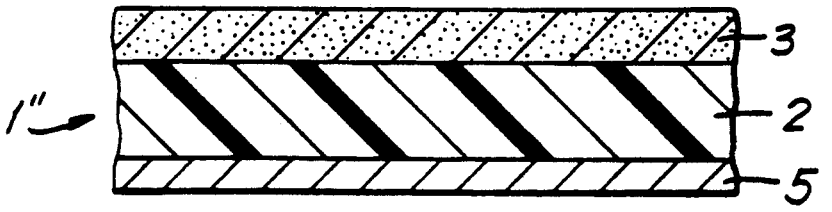
FIG. 3 is a sectional view of a reusable ink sheet constructed in accordance with another embodiment of the invention.

FIG. 1 depicts an ink sheet 1 formed in accordance with the invention including a conductive ink layer 3 laminated on a dielectric bass layer 2. FIG. 2 illustrates an ink sheet 1' constructed in accordance with another embodiment of the invention in which conductive ink layer 3 is laminated on a dielectric layer 2' which is formed on a supportive base layer 4. FIG. 3 illustrates another ink sheet 1" formed in accordance with yet another embodiment of the invention. Ink sheet 1" is formed of conductive ink layer 3 formed on a dielectric supportive base layer 2 that is formed on a conductive layer 5. Base layer 4 of ink sheet 1' can serve as a dielectric layer or a conductive layer. Base layer 2 has a supportive property as well as a dielectric property, while dielectric layer 2' is only designed to be insulating features taken into consideration.

Ink sheets 1, 1' and 1" are merely illustrative of constructions of ink sheets formed in accordance with the invention. While such ink sheets must include a conductive ink layer on a dielectric layer, additional layers having various properties may advantageously be included therein. Ink sheets 1, 1' and 1" can be employed in a thermal fusion image forming system and ink sheets 1' and 1" can be used with an energizing thermal image forming system.

Base layer 2 which serves as a supportive layer and an insulating layer can be formed with any insulating material, such as an organic film of polyester, polysulfone, polyimide, polyamide, polyaramide or polycarbonate; a film formed by dispersing oxides and nitrides into a binder resin containing at least one resin selected from the group including thermoplastic resins such as polyvinyl alcohol, polyvinyl pyrrolidone, polyvinyl amine, gum arabic, polyglutamic acid, polyvinyl chloride, polycarbonate, polyvinyl butyral, polystyrene, polyacrylate, polyester and cellulose resin; thermosetting resins such as epoxy resin, silicone resin, urethane resin, melamine resin and alkyd resin; film composed of oxides and nitrites. Preferably, the film includes heat-resistant easy-to-form materials such as polyester, polysulfone, polyimide and polyaramide.

Dielectric layer 2' may be formed of the foregoing binder resins; or of the foregoing binder resins by dispersing oxides and nitrides into the binder resin; or of the oxides and nitrides themselves.

Conductive ink layer 3 can include conductive components typically found in conductive ink such as, at least one conductive agent. Examples of conductive agents include carbon black (e.g., furnace black and acetylene black), conductive metal powder oxides (e.g., ITO powder and $SnO_2$ powder), metal powders, (e.g., Ag powder and Al powder), conductive salts (e.g., quaternary ammonium salt) and conductive resins (e.g., polyacetylene and polypyrol). If desired, conductive ink layer 3 can further include additives selected from the following groups of materials:

1) waxes such as candelilla wax, carnuba wax, rice wax, beeswax, lanolin, montan wax, ozocerite, paraffin wax microcrystalline wax, petrolatum, polyethylene wax, Fischer Tropsh wax, montan wax derivatives, paraffin wax derivatives, hardened castor oil and synthetic wax; high-grade aliphatic acids such as stearic acid, palmitic acid; and stearin acid; polyolefins such as low molecular weight polyethylene, polyethylene oxide and polypropylene; and olefin copolymers such as ethylene acrylate copolymer, ethylene acrylate ester copolymer and ethylene-vinyl acetate copolymer; and combinations thereof.

2) one of the above-mentioned binder resins or a composite thereof;

3) coloring agents such as: black colorant elements (dyes and pigments) including furnace black, lamp black, acetylene black and nigrosine; cyanic colorants like copper phthalocyanine, magenta colorant like carmine 6B; and yellow colorant like disazo yellow;

4) magnetic powders such as $Fe_3O_4$, $Fe_2O_3$, Fe, Cr and Ni;

5) dispersants or interface activators such as metal soap and polyethylene glycol;

6) electrification control agents such as an electron-receivable organic complex, chlorinated polyester, nitrophmine, quaternary ammonium salt and pyridium salt;

7) fillers such as talc; and 8) fluid improvers like $SiO_2$ and $TiO_2$.

In addition to the foregoing films, base layer 4 may include a film including conductive resins and a film formed by dispersing and dissolving conductive agents and/or conductive resins therein. Conductive layer 5 is formed from conductive resins, or alternatively by dispersing or dissolving a conductive agent in a binder resin therein.

Figure 4:
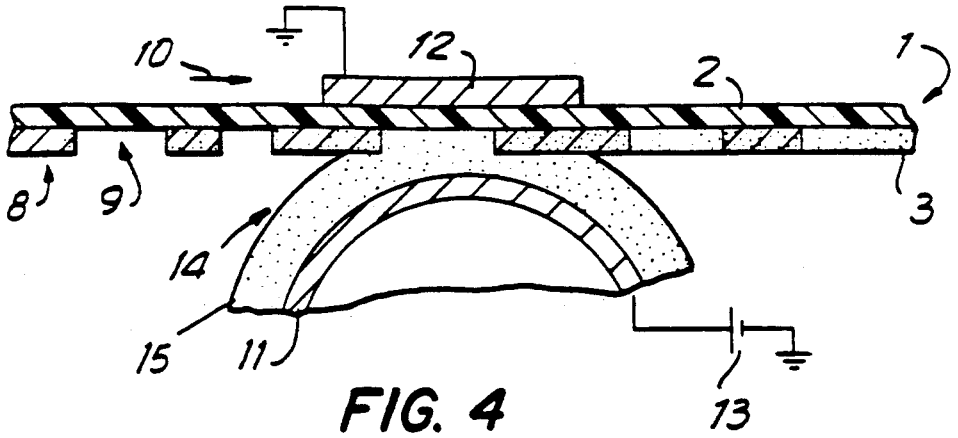
FIG. 4 is a partial sectional view of an apparatus for replenishing depleted portions of an ink layer constructed in accordance with an embodiment of the invention.

The method for replenishing depleted ink layers in accordance with a first embodiment of the invention is illustrated schematically in FIG. 4 in connection with an ink sheet 1 shown in FIG. 1. The same components are identically numbered throughout the drawings.

Ink sheet 1 includes conductive ink layer 3 with a plurality of non-recorded portions 8 and a plurality of voids 9 where portions of conductive ink layer 3 have been transferred to a transfer medium. As ink sheet 1 travels in the direction of an arrow 10, it passes intermediate a rotating electrode 11 and an oppositely charged electrode 12. Electrode 11 is disposed at a fixed interval from ink layer 3 of ink sheet 1 and oppositely charged electrode 12 is positioned in contact with dielectric base layer 2. A voltage source 13 applies a charge to electrode 11 which induces an opposite charge in electrode 12 and a bias voltage $V_b$ between electrode 11 and oppositely charged electrode 12.

Electrode 11 rotates in the direction of an arrow 14 and has a coating of conductive replacement ink 15 adhered thereto. Various restraining mechanisms and forces can be used to hold conductive ink 15 on rotating electrode 11. These included magnetic force, electrostatic force, such as image force and coulomb force and Van der Waals forces. Sufficient conductive ink 15 adheres to electrode 11 to fill in the space between electrode 11 and ink layer 3. Conductive ink 15 may be powdered ink, conductive powdered matter, paste ink, or ink having a molten or half-molten state.

Conductive ink 15 which fills voids 9 where ink from ink layer 3 has been removed, contacts base layer 2 of ink sheet 1 and sets up a conductive path. Due to bias voltage $V_b$ between electrode 11 and oppositely charged electrode 12, when conductive ink 15 fills the gap between electrodes 11 and 12, current flows through this quantity of conductive ink 15 which receives an electric charge q. Charge q is proportional to the product of bias voltage $V_b$ and the electrostatic capacity of dielectric layer 2 of ink sheet 1. An electric charge $-q$ is induced in oppositely charged electrode 12 and is imparted to base layer 2 established as the dielectric layer. Alternatively, base layer 2 serving as the dielectric layer is polarized in a dielectric manner, depending on whether there is an additional base layer on ink 15.

A quantity of conductive ink 15 within voids 9 adheres to dielectric base layer 2 to fill in voids 9 and is held in place by the electrostatic forces "Coulomb forces" of these electric charges. The magnitude of q is sufficient to overcome the restraining force of electrode 11 on ink 15.

When a quantity of conductive ink 15 between electrode 11 and oppositely charged electrode 12 contacts non-recorded portions 8, the current flowing from electrode 11 to electrode 12 flows through replacement ink 15 to non-recorded portions 8. Accordingly, electrostatic forces are not built up between ink 15 and base layer 2 of ink sheet 1 and ink 15 remains attracted to electrode 11. In this fashion, conductive replacement ink 15 selectively adheres to base layer 2 of ink sheet 1 at void regions 9 and not to nonrecorded portions 8.

Figure 5:
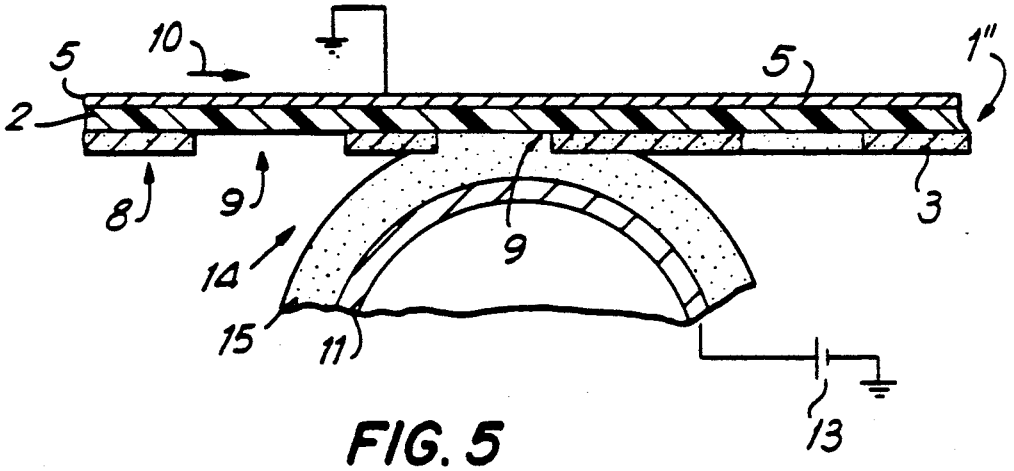
FIG. 5 is a partial sectional view of an apparatus for replenishing depleted portions of an ink layer constructed in accordance with another embodiment of the invention.

FIG. 5 schematically illustrates replenishment of ink on ink sheet 1" accordance with another embodiment of the invention. Ink sheet 1" includes conductive layer 5 disposed on the surface of dielectric base layer 2 opposite to ink layer 3. Conductive layer 5 is grounded and serves as the oppositely charged electrode 12 in accordance with the embodiment illustrated in FIG. 4. Electrode 11 is placed at a distance from conductive ink layer 3 and conductive replacement ink 15 is held on electrode 11 rotating in the direction of arrow 14 by restraining means and restraining forces.

Bias voltage $V_b$ from voltage source 13 causes charges to flow through conductive replacement ink 15 from electrode 11 towards conductive layer 5. Conductive ink 15 in void regions 9 is in contact with dielectric base layer 3 and establishes a conductive path and receives a charge q. An opposite charge $-q$ is induced at conductive layer 5. Conductive ink 15 adheres to dielectric layer 2 and fills in void region 9 of conductive ink layer 3. The electrostatic force from charge q is sufficient to overcome forces restraining conductive replacement ink 15 to electrode 11. The charges flowing through conductive ink 15 contacting non-recorded portions 8 discharge into ink layer 3 at non-recorded portions 8 and there is insufficient electrostatic force to adhere ink 15 to base layer 2 of ink sheet 1. As in the embodiment illustrated in FIG. 4, ink 15 is selectively transferred to fill in voids 9 and does not adhere to non-recorded portions 8.

Figure 6:
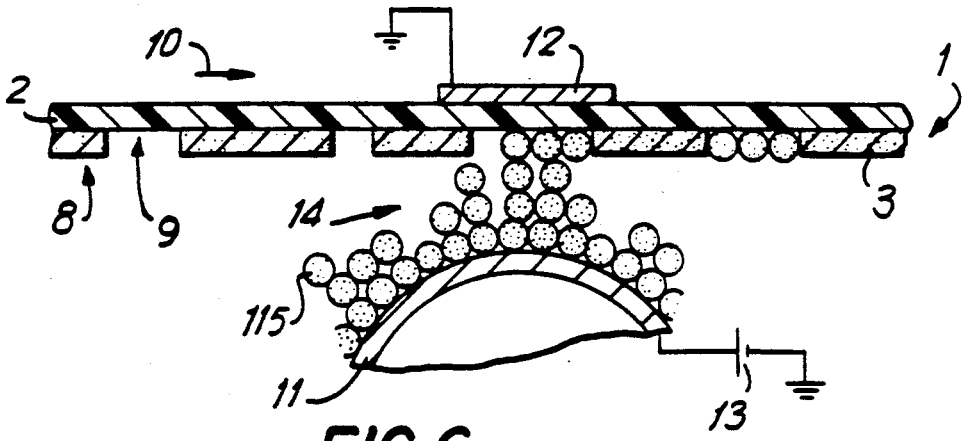
FIG. 6 is a partial sectional view of an apparatus for replenishing depleted portions of an ink layer constructed in accordance with an another embodiment of the invention.

FIG. 6 illustrates another apparatus for replenishing ink sheet 1 of FIG. 1 using a conductive replacement ink powder 115. The method of operating this apparatus is similar to the method illustrated in FIG. 4. Ink sheet 1 is displaced in the direction of arrow 10 and is positioned a fixed interval from electrode 11 and in contact with electrode 12 on the opposite side of ink sheet 1. Voltage supply source 13 applies a potential $V_b$ between electrodes 11 and electrode 12 and conductive replacement ink powder 115 fills the gap between electrode 11 and ink sheet 1 to serve as a conductive path.

Conductive ink powder 115 is restrained on electrode 11 rotating in the direction of arrow 14 by previously described restraining means and forces. When a quantity of conductive powder 115 fills voids 9 and contacts dielectric layer 2 conductive ink powder 115 receives a charge q. This induces a charge of $-q$ in oppositely charge electrode 12 which is thereby imparted to base layer 2 defined as the dielectric layer. Alternatively, base layer 2 serving as the dielectric layer is polarized in the dielectric manner. Charge $-q$ and charged conductive ink powder 115 is attracted to dielectric layer 2 by electrostatic force which is strong enough to overcome the force restraining ink powder 115 on electrode 11.

The portion of conductive powder 115 that contacts nonrecorded portions 8 will not adhere to ink layer 3 of ink sheet 1. Current flowing through conductive powder 115 will discharge into non-recorded portions 8 of conductive ink layer 3. Powder 115 will not receive any electrostatic adhesion to ink sheet 1 and will remain restrained to electrode 11. In this manner, a uniformly thick and smooth conductive ink layer 3 results from the replenishing process.

In this manner, conductive powder 115 is selectively adhered to voids 9 of conductive ink layer 3. When conductive powder 115 is used as the conductive ink, conductive powder 115 can be adhered to voids 9 of conductive ink layer 3 in a substantially monolayer configuration. This facilitates control over the amount of ink re-supplied to the sheet and ink layer thickness which is dependent on both the particle diameter of conductive powder 115 and the bias voltage $V_b$.

Conductive replacement ink powder 115 preferably contains at least one binder material, such as waxes, high-grade aliphatic acids, polyolefins and olefin copolymers to enhance its thermal transcriptive property. The conductive powder can be produced by well-known dry-type pulverizing methods, wet type pulverizing methods, or microcapsule encapsulating methods. If desired, the conductive powder can undergo surface processing.

If the conductive powder contains any of the binder materials selected from the groups including waxes, high-grade aliphatic acids, polyolefins and olefin copolymers, the powder is soft and tends to condense. Hence, it is desirable to add the conductive agent externally and add fluid improvers, encapsulate the binder with a resin having a relatively high melting point and effect surface processing by eliminating relatively low molecular weight components with an organic solvent. It should be noted that the conductive agent may be added internally and/or eternally to the powder as a conductive core and/or coating.

Figure 7A:
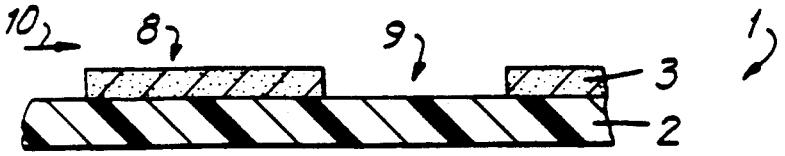
FIGS. 7A, 7B, 7C and 7D are partial sectional views illustrating the steps of a method for applying ink powder to depleted portions of an ink layer in accordance with an embodiment of the invention.
Figure 7B:
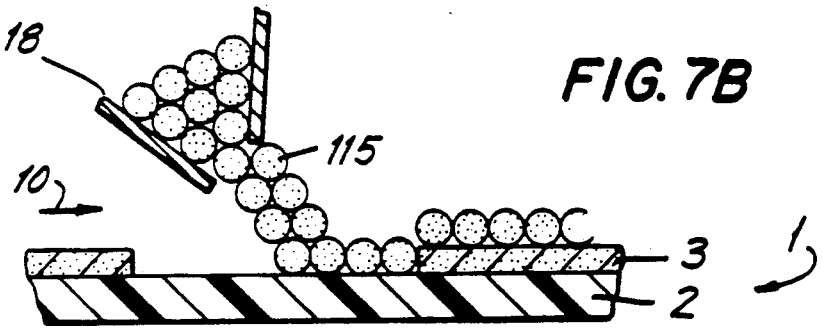

FIGS. 7A, 7B, 7C and 7D illustrate still another embodiment of replenishing ink sheet 1 in accordance with the invention. In the FIGURES the symbol "+" indicates a positive electric charge and the symbol "−" indicates a negative electric charge. Note that in these FIGURES, conductive powder 115 is exemplified as conductive ink. As in the earlier described embodiments, ink sheet 1 has non-recorded portions 8 and voids 9 and is transported in the direction of arrow 10 by an unillustrated carrier mechanism. Conductive powder 115 is continuously fed onto ink sheet 1 by a conductive powder feeder 18 as shown in FIG. 7B. In this case, conductive powder 115 is preferably laminated on the ink sheet.

An electric charger 19 is positioned above conductive ink layer 3 either contiguous with or spaced away from ink sheet 1. Electrode 12 is disposed close to base layer 2 which serves as the dielectric layer of ink sheet 1 on the side opposite to electric charger 19. An electric charge q from charger 19 is transferred to conductive powder 115. Consequently, an electric charge −q is induced in electrode 12 and electric charge —q is imparted to base layer 2 as the dielectric layer. Alternatively, base layer 2 defined as the dielectric layer is polarized in the dielectric manner.

Figure 7C:
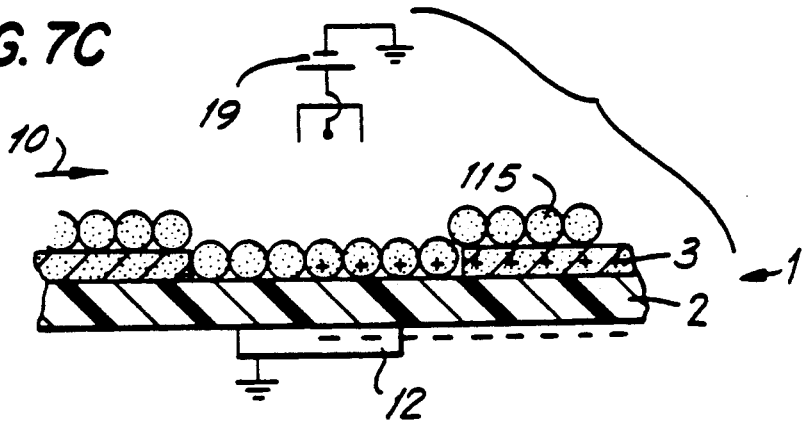

Electric charges imparted to conductive powder 115 contacting non-recorded portions 8 continue to flow into conductive ink layer 3. Consequently, conductive powder 115 contacting portions 8 does not receive an electric charge. Conductive powder 115 which contacts dielectric layer 2 holds its charge as is illustrated in FIG. 7C because there is no further path for charge q from charger 19 to travel.

Figure 7D:
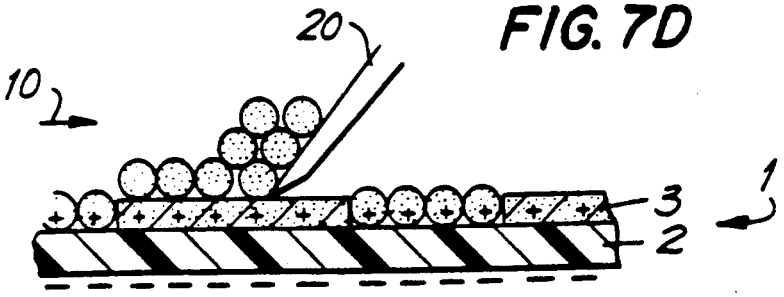

Uncharged ink powder 115 which does not adhere to base layer 2 of ink sheet 1 should be removed from the surface of ink sheet 1. Accordingly, a conductive powder eliminator 20 is included, either contiguous with or spaced away from ink layer 3 to remove non-charged ink powder 115 as shown in FIG. 7D. This makes it possible to selectively adhere conductive ink 115 in voids 9 of conductive ink layer 3 without supplying additional replacement ink powder 115 to non-recorded portions 8.

Figure 8:
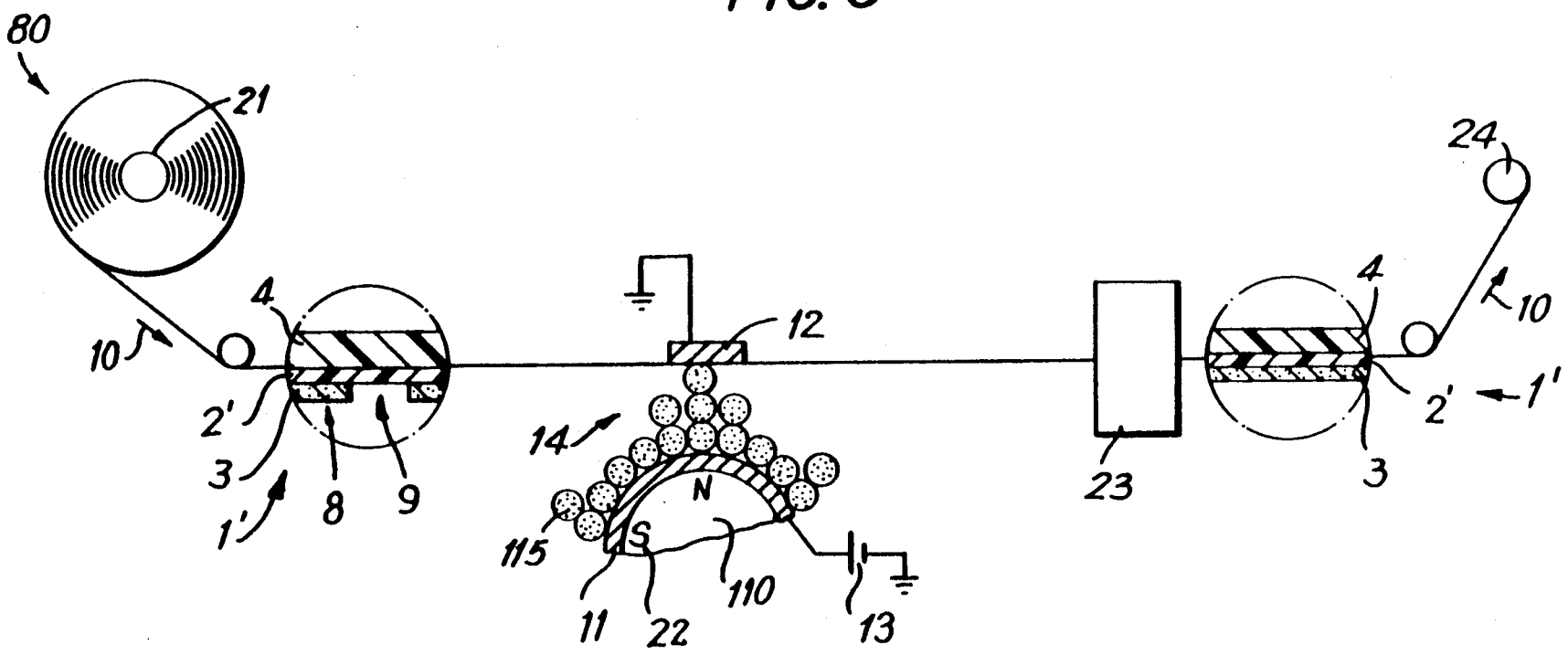
FIG. 8 is a schematic view illustrating an apparatus for applying ink powder to depleted portions of an ink layer in accordance with another embodiment of the invention.

An apparatus 80 for replenishing ink sheet 1' of FIG. 2 having non-recorded portions 8 and voids 9 of conductive ink layer 3 is illustrated in FIG. 8. Ink sheet 1' is wound on a roller 21 with the free end transported in the direction of arrow 10 past a conductive sleeve 110 including a multi-polar magnet 22 and electrode 11 disposed a fixed interval from conductive ink layer 3. Electrode 12 is positioned to contact base layer 4 of ink sheet 1' on the side opposite electrode 11. If ink sheet 1' includes an outer conductive layer, electrode 12 can be eliminated and the bias voltage is applied between electrode 11 and that outer conductive layer.

Voltage supply source 13 applies a bias voltage $V_b$ between electrode 11 and opposite electrode 12. Replacement conductive ink powder 115 is restrained on electrode 11 which rotates in the direction of arrow 14 by magnetic force. Conductive ink powder 115 is fed onto ink layer 3 of ink sheet 1' as it passes electrode 11. Replacement conductive ink 115 may be powdery, in a paste-like state or in a molten or half-molten state, but contains magnetic powder. FIG. 8 illustrates the case where conductive replacement ink 115 is a powder.

Upon application of bias voltage $V_b$, conductive ink powder 115 contiguous with ink sheet 1' is given electric charge q. Electric charge q is imparted to conductive ink 115 that fills in voids 9 and contacts dielectric layer 2' of ink sheet 1'. An opposite charge of −q is induced in electrode 12 which is then applied to base layer 4. Alternatively, base layer 4 and dielectric layer 2', or dielectric layer 2' alone is polarized in the dielectric manner. Conductive ink powder 115 adheres to ink sheet 1' by the electrostatic forces of these charges to fill in voids 9 because these forces are stronger than the magnetic forces restraining conductive ink powder 115 to rotating electrode 11. In the same manner as in the earlier described embodiment, charges applied to conductive ink powder 115 which contact conductive ink layer 3 discharge into conductive ink layer 3, and ink 115 is not electrostatically adhered to ink sheet 1'. This portion of conductive ink 115 remains restrained by the magnetic force to electrode 11.

After conductive ink 115 is selectively adhered in voids 9, of conductive ink layer 3, conductive ink 115 is fixed onto ink sheet 1' by an ink fixing device 23, and replenished ink sheet 1' is wound on a winding roller 24. Ink fixing device 23 can be a heat fixer or pressure fixer, such as those known for inclusion in electrophotography systems such as heat roll fixing devices, pressure fixing devices and flash fixing devices. Replenished ink sheet 1' can then be re-used in a thermal transcription-type image forming system. The apparatus for replenishing ink sheets constructed in accordance with the invention can be used to manufacture an ink sheet in the first instance. It is also possible to adhere the conductive ink onto the ink sheet and fix the conductive ink onto the ink sheet in separate apparatuses.

FIG. 9 is a schematic diagram depicting an image forming system 90 incorporating an ink sheet replenishing apparatus 34 constructed in accordance with an embodiment of the invention. Image forming system 90 includes an endless ink sheet 1 rotating about a series of rollers 36 in the direction of an arrow 30. Ink sheet 1 includes dielectric base layer 2 and conductive ink layer 3 formed thereon as described above. A thermal transcription image forming device 31 forms an image on a transfer medium 33 moving in the direction of an arrow 32 by transferring selected portions of ink layer 3 onto transfer medium 33. This transfer of ink leaves non-recorded portions 8 and voids 9 of conductive sheet ink layer 3 on ink sheet 1.

Ink replenishing device 34 replenishes voids 9 with conductive replacement ink. An ink fixing device 35 fixes this replacement ink onto ink sheet 1 to yield a regenerated ink sheet 1 which is ready to form images on transfer medium 33 by image forming device 31. Images are thereby formed while the ink sheet continues to be regenerated.

A color image forming system 100 for continuously forming multi-color images in accordance with the invention is depicted in FIG. 10. System 100 includes an endless multi-color ink sheet 101 which is transported in the direction of arrow 30 as sheet 1 in FIG. 9. Endless multi-color ink sheet 101 includes a conductive ink layer 103 which includes bands of yellow, cyan, magenta and black (hereinafter abbreviated to Y, C, M, and Bk, respectively). A color thermal transcription image forming device 131 is provided to form sequentially yellow, cyan magenta and black images on a transfer medium 133 which reciprocates in the directions indicated by a double arrow 132.

After transferring colored ink portions to transfer medium 133, ink sheet 101 includes non-recorded portions 108 and voids 109 of multi-color conductive ink layer 103. System 100 further includes a plurality of color ink replacement devices 134Y, 134M, 134C and 134Bk for replacing conductive ink having the colors yellow, magenta, cyan and black. Replenished ink then passes through conductive ink fixing device 135 which fixes the replenished conductive ink to ink sheet 101 to regenerate ink sheet 101. Ink sheet 101 is then in condition to produce further color images. Multi-color images are formed as the ink sheet is continuously regenerated.

Replenishment of ink sheets in accordance with the invention will be described are the following Examples. These Examples are set forth for purposes of illustration and not intended in a limiting sense.

EXAMPLE 1

An ink sheet similar to ink sheet 1 of FIG. 1 was constructed with a 4 μm thick polyester film base layer 2 serving as the dielectric layer. A 3 μm thick conductive ink layer 3 was coated on base 2, with a mixture of the following materials:

| | |
|---|---|
| Paraffin Wax | 0.9 × (59 − Y) wt % |
| Ethylene-vinyl Acetate Copolymer | 0.1 × (59 − Y) wt % |
| $Fe_3O_4$ | 40 wt % |
| Colloidal silica ($SiO_2$) | 1 wt % |
| Carbon black | Y wt % |

Ink layers having different proportions of carbon black with Y set to 10, 7, 4 and 0 were formed. These ink sheets were designated by a, b, c and d, respectively, and the ink compositions were made into conductive powders a', b', c' and d', each having a volume means particle diameter of 10μm.

Selected portions of the conductive ink layer of ink sheets a, b, c and d were transcribed using a thermal transcription image forming system. The depleted ink sheets were replenished with conductive powders by ink sheet reproducing method and apparatus similar to that shown in FIG. 6. Then conductive powders were fixed to the ink sheets by a heat roll fixing device. In this case, $V_b$ was set at 70 V, and the surface temperature of the heat roller was set at 180° C.

As can be seen from Table 1, the volume resistivity of the conductive ink layer should be about $10^6 \Omega$·cm or less to adhere the conductive ink powder to the depleted portions of the ink layers selectively. The same high quality printed images were obtained from replenished portions of ink sheets a and b as were formed from original, non-recorded portions.

TABLE 1

| I | a | b | c | d |
|---|---|---|---|---|
| C | a' | b' | c' | d' |
| ρ(Ω · cm) | $10^2$ | $10^4$ | $10^6$ | $10^{13}$ |
| T | ○ | ○ | ○ | L |
| N | X | X | ▲ | L |
| Di (μm) | 3.0 | 3.0 | 3.0 | 5.0 |
| H | ○ | ○ | ○ | X |

I: Ink sheet
C: Conductive ink powder
ρ: Volume resistivity of the ink layer
T: Condition of ink powder adhering to depleted portions of the ink layer
N: Condition of ink powder adhering to non-recorded portions of the ink layer
Di: Mean thickness of the ink layer after regeneration.
H: Surface smoothness after regeneration.
Adhesion (T and N)
○: Substantially mono-layer adhesion
▲: Almost no adhesion (10% mono-layer)
X: No adhesion (less than 2% mono-layer)
L: Larger than mono-layer adhesion
Surface Condition (H)
○: No rough portions
X: Rough portions exist

EXAMPLE 2

An ink sheet similar to ink sheet 1' of FIG. 2 was prepared with a 4 μm thick polysulfone film base layer and a 1 μm thick dielectric layer formed with the following materials:

| | |
|---|---|
| Polyester | (100 − Y) wt % |
| Carbon black | Y wt % |

Dielectric layer with various proportions of carbon black with Y set to 0, 3, 5 and 7 were prepared. The individual ink sheets are represented by e, f, g and h, respectively. A 3 μm thick layer of conductive ink was formed by mixing and kneading the following materials:

| | |
|---|---|
| Paraffin wax | 42 wt % |
| Carnauba wax | 5 wt % |
| Polyethylene oxide wax | 5 wt % |
| $Fe_3O_4$ | 40 wt % |
| Carbon black | 8 wt % |

The volume resistivity of the conductive ink layer after coating was $10^3 \Omega$·cm. A conductive powder having the same composition as that of the conductive ink layer was prepared. Some portions of the conductive ink layers of ink sheets e through h were transferred by a thermal transfer image forming system. The ink sheets were then replenished with conductive powder by an ink sheet regeneration method and apparatus similar to that depicted in FIG. 6. The conductive powder was fixed to the ink sheet by a heat roll fixing device; Vb was set to 60 V; and the surface temperature of the heat roller 2 was set at 180° C.

TABLE 2

| I | e | f | g | h |
|---|---|---|---|---|
| ρ(Ω · cm) | $10^{15}$ | $10^8$ | $10^6$ | $10^5$ |
| T | ○ | ○ | ▲ | X |
| N | X | X | X | X |
| Di (μm) | 3.0 | 3.0 | 2.8 | 2.0 |
| H | ○ | ○ | ▲ | X |

I: Ink sheet
ρ: Volume resistivity of the dielectric layer
T: Condition of conductive powder adhering to depleted portions of the ink layer
N: Condition of conductive powder adhering to non-recorded portions of the ink layer
Di: Mean thickness of the ink layer after regeneration
H: Surface smoothness after regeneration
Adhesion (T and N)
○: nearly mono-layer adhesion
▲: Almost no adhesion (10% mono-layer)
X: No adhesion (less than 2% mono-layer)
Surface Condition (H)
○: No roughened portion
▲: Somewhat roughened
X: Roughened portions As shown in Table 2, the volume resistivity of the dielectric layer should be more than about $10^6 \Omega$·cm to adhere the conductive powder onto the dielectric layer in a substantially monolayer state. The quality of images formed with ink sheets e and f did not deteriorate even after repeating the operations of regeneration and image-formation more than 1000 times.

EXAMPLE 3

An ink sheet similar to ink sheet 1'' of FIG. 3 was prepared with conductive layer on the opposite side of the ink layer of the ink sheet a from Example 1.

| | |
|---|---|
| Polyester | 90 wt % |
| Carbon black | 10 wt % |

where the thickness was 2 μm, and the volume resistivity was $10^3$ Ω·cm.

After repeating energization thermal transfer based image formation and regeneration of the ink sheet by the ink sheet replenishing method and apparatus depicted in FIG. 5 using ink sheet a and conductive powder a', the image quality was the same as in Example 1 even after repeating the operations of regeneration and image formation more than 1000 times.

EXAMPLE 4

An ink sheet similar to ink sheet 1' of FIG. 2 was prepared with a 4 μm thick polyaramide film containing carbon black as the base layer and a 1 μm thick polycarbonate dielectric layer. The conductive ink layer was a 3 μm thick layer formed of a mixture of the following materials:

| | |
|---|---|
| Polyethylene oxide wax | 40 wt % |
| Ethylene-vinyl acetate copolymer | 10 wt % |
| $Fe_3O_4$ | 42 wt % |
| Carbon black | 6 wt % |
| $TiO_2$ | 2 wt % |

The ink sheet was repeatedly replenished by an ink sheet regeneration method and apparatus similar to that depicted in FIG. 5. Images were repeatedly formed by thermal transcription. No deterioration in quality of the ink sheet in connection with the regeneration of the ink sheet was found. High quality images were invariably obtained.

EXAMPLE 5

An ink sheet similar to ink sheet 1 of FIG. 1 was formed with a 4.5 μm thick polyester dielectric layer. The dielectric layer was coated with a 3 μm thick conductive ink layer formed of a mixture obtained by mixing and dispersing 0, 10, 20 and 30 parts by weight of carbon black into the following materials:

| | |
|---|---|
| Paraffin wax | 90 parts by weight |
| Ethylene-vinyl acetate copolymer | 9 parts by weight |
| $Fe_3O_4$ | 100 parts by weight |
| $TiO_2$ | 1 part by weight |

The resulting ink sheets were denoted i, j, k, and l, respectively. Conductive powders i', j', k' and 1' each having a volume mean particle diameter of 10 μm were formed from the foregoing dispersed mixture.

Ink was transferred from portions of the conductive ink layers of these ink sheets by a thermal transfer image forming system. Afterwards, ink replenishing was accomplished by an ink sheet regeneration apparatus similar to that depicted in FIG. 6. A heat roll fixing device was employed to fix the ink to the sheet and the surface temperature of the heat roller was set at 150° C.

TABLE 3

| I | i | j | k | l |
|---|---|---|---|---|
| C | i' | j' | k' | l' |
| ρ(Ω · cm) | $10^{14}$ | $10^6$ | $10^4$ | $10^3$ |
| T | L | ○ | ○ | ○ |
| N | L | ▲ | X | X |
| J | X | ▲ | ○ | ○ |
| Di (μm) | 4.2 | 3.1 | 3.0 | 3.0 |
| H | X | ○ | ○ | ○ |

I: Ink sheet
C: Conductive powder
ρ: Volume resistivity of the ink layer
T: Condition of conductive powder adhering to depleted portions of the ink layer
N: Condition of ink powder adhering to non-recorded portions of the ink layer
J: Conclusion whether conductive powder is selectively adhered, or not
Di: Mean thickness of the ink layer after regeneration.
H: Surface Smoothness
Selective Adhesion (J)
○: Good
▲: Relatively poor
X: Poor
Adhesion (T and N)
○: Substantially mono-layered
▲: Almost no adhesion (10% mono-layer)
X: No adhesion (less than 2% mono-layer)
L: Larger than mono-layer
Ink Layer Smoothness (H)
○: Not Rough
X: Rough portions exist The results of evaluating the adhesion of replenished ink powder with a bias voltage of 68V are shown in Table 3. It was confirmed that the volume resistivity of the conductive ink layer should be $10^6$Ω·cm or less, as in Example 1 so that conductive powder is selectively adhered only to the transcribed portion of the ink layer.

The amount of adhesion of ink powder can be controlled by regulating the bias voltage on the effect of changing bias voltage $V_b$. An ink sheet k and conductive powder k' were evaluated and the results are summarized in Table 4. Through not shown in the Table 4, even when Vb≧68V, a relation such as Mt=1.21 mg/cm² remains stable.

TABLE 4

| Vb (V) | 0 | 23 | 45 | 68 |
|---|---|---|---|---|
| Qt (nC/cm²) | 0.01 | 13.6 | 26.6 | 40.0 |
| Mt (mg/cm²) | 0.00 | 0.92 | 1.21 | 1.21 |
| Mn (mg/cm²) | 0.00 | 0.00 | 0.00 | 0.00 |
| Di (μm) | 1.3 | 2.6 | 3.0 | 3.0 |

Qt: electric charge imparted to the conductive powder adhered to the transcriptive portion of the ink layer.
Mt: amount of conductive powder adhered to the depleted portions of the ink layer.
Mn: amount of conductive powder adhered to the non-recorded portion of the ink layer.
Di: film thickness of the ink layer after the conductive powder has been fixed As shown in Table 4, the amount of adhesion of conductive powder to the depleted portion of the ink layer depends on bias voltage $V_b$. In this embodiment, when $V_b' \geqq 10V/\mu m$, a fairly constant amount of adhesion is exhibited, which indicates substantially monolayer adhesion when the bias voltage is greater about 10V/μm.

The effects of varying the volume mean particle diameter of the conductive powder ink powder adhesion was evaluated. The average particle diameter of conductive powder k' was changed to 5, 15 and 20μm, which were denoted $k'_5$, $k'_{15}$ and $k'_{20}$ respectively. Table 5 shows the results of examining the film thickness of the ink layer of ink sheet after reproducing the ink sheet by using these conductive powders matter with $V_b$=68V.

TABLE 5

| C | $k'_5$ | k' | $k'_{15}$ | $k'_{20}$ |
|---|---|---|---|---|
| Di (μm) | 2.2 | 3.0 | 3.9 | 4.7 |

C: conductive powder
Di: film thickness of the ink layer fixing the after conductive powder.

As seen from Table 5, the film thickness of the ink layer after fixing the conductive powder can be adequately controlled by regulating the particle diameter of the conductive powder. In this embodiment, when using conductive powders having a volume mean particle diameter of 10μm, the film thickness of the ink layer after fixation coincide with the initial film thickness of the ink layer.

EXAMPLE 6

An ink sheet similar to ink sheet 1 of FIG. 1 was formed with a 5μm thick polyaramide film base layer conceived as the dielectric layer. A 3μm thick conductive ink layer was formed thereon of a mixture of the following materials:

| | |
|---|---|
| Polyethylene oxide wax | 50 parts by weight |
| Carnauba wax | 100 parts by weight |
| Microcrystalline wax | 100 parts by weight |
| Colloidal silica ($SiO_2$) | 2 parts by weight |
| Carbon black | 30 parts by weight |

Conductive powder having a volume mean particle diameter of 10μm was produced from this mixture, having a resistivity of $5\times10^3$ Ω·cm.

Images were formed with the ink sheet by printing with a thermal head. Subsequently, conductive powder was adhered to the depleted portions of the ink layer by an ink sheet replenishing method and apparatus similar to that illustrated in FIG. 6. The conductive powder was restrained to the rotating electrode by Van der Waals forces, and the bias voltage $V_b$ was set to 60V. The conductive powder transferred to the ink sheet was fixed by a heat roll fixing device having a heat roller surface temperature of 160° C. The ink layer of the replenished ink sheet was formed without a rough surface and ink layer's initial thickness of 3.0μm was retained.

EXAMPLE 7

The relationship between the adhering condition of the conductive powder onto the ink sheet and the volume resistivity of the conductive powder (and of the conductive ink layer) of an apparatus similar to that depicted in FIG. 6 was examined. A conductive powder having a volume mean particle diameter of 11μm was prepared by mixing, kneading, pulverizing and classifying the following materials:

| | |
|---|---|
| Polyethylene oxide wax | (38 − Y) wt % |
| Microcrystalline wax | 20 wt % |
| $Fe_3O_4$ | 40 wt % |
| $SiO_2$ | 2 wt % |
| Carbon Black | Y wt % |

Y was set to 1, 1.5, 2, 3, 4 and 6 to obtain powders of various compositions. These conductive powders were designated m', n', o', p', p' and r', respectively. Table 6 shows the volume resistivities (hereinafter designated by ρ) of the powders in association with a pressure cell. The volume resistivities are converted from resistance values when applying both a pressure of 10 kg/cm² and an electric filed of 100V/cm in the axial direction under an arrangement in which the powder is charged into a cylindrical recess having a diameter of 5 mm, the upper and lower surfaces of which are provided with metal electrodes.

The base layer defined as the dielectric layer of an ink sheet similar to ink sheet 1 was formed of a 6μm thick polyaramide film. The conductive ink layers, formed on ink sheets m, n, o, p, q and r were 3μm thick ink layers composed of conductive powders m', n', o', p', q' and r'. Transcription was effected from selected portions of the conductive ink layers of these ink sheets by a thermal transcription image forming system. The bias electric field of ($V_b'$) was set at 25V/μm, the value obtained by dividing bias voltage $V_b$ by the film thickness of the dielectric layer, where $V_b = 150$V. The results are summarized in Table 6.

TABLE 6

| I | C | ρ(Ω · cm) | T | N | J |
|---|---|---|---|---|---|
| m | m' | $8\times10^{11}$ | ○ | ○ | X |
| n | n' | $1\times10^{8}$ | ○ | ○ to ▲ | ▲ |
| o | o' | $4\times10^{6}$ | ○ | ▲ to X | ○ |
| p | p' | $6\times10^{5}$ | ○ | X | ○ |
| q | q' | $3\times10^{4}$ | ○ | X | ○ |
| r | r' | $1\times10^{3}$ | ○ | X | ○ |

I: Ink sheet
C: Conductive powders
ρ: Volume resistivity of conductive powder
T: Condition of ink powder adhering to depleted portions of the ink layer
N: Condition of ink powder adhering to non-recorded portions of the ink layer
J: Judgement regarding condition of sheet
Adhesion Conditions (T and N)
○: Substantially mono-layer
▲: Almost no adhesion (10% mono-layer)
X: No adhesion (2% or more mono-layer)
Selective Adhesions (J)
○: good condition
▲: relatively poor
X: poor As shown in Table 6, each of the volume resistivities of the conductive powder and of the ink layer in association with the pressure cell should be smaller than about $10^8$ Ω·cm, preferably smaller than about about $5\times10^6$ Ω·cm, and most preferably smaller than $10^6$ Ω·cm to adhere the conductive powder to the depleted transcripted portion of the conductive ink layer of the ink sheet.

It is further evident that the volume resistivity of the base layer serving as the dielectric layer or of the dielectric layer should be larger than $10^6$ Ω·cm, preferably larger than $10^8$ Ω·cm, and most preferably larger than $10^{10}$ Ω·cm to adhere the conductive powder to the depleted transcription portion of the ink sheet, i.e. the base layer defined as the dielectric layer or the dielectric layer of the ink sheet.

EXAMPLE 8

The relationship between bias voltage $V_b$ and amount of adhesion of conductive powder was further examined by using an ink sheet reproducing method and apparatus similar to that depicted in FIG. 6. Conductive powders used were prepared with the following:

| | |
|---|---|
| paraffin wax | 30 wt % |
| carnauba wax | 28 wt % |
| carbon black | 2 wt % |
| $Fe_3O_4$ | 40 wt % |

The conductive powders were prepared by mixing, kneading, pulverizing and classifying those materials to obtain inner core particles each having a volume means particle diameter of 10μm. The following materials were then mixed with and externally added to provide a surface counting to 100 parts by weight of such particles:

| | |
|---|---|
| Polystyrene | 8 parts by weight |

-continued

| | |
|---|---|
| Carbon black | 2 parts by weight |

In this case, the volume resistivity $\rho$ of the conductivity powder in association with the pressure cell was $5\times10^3$ $\Omega$·cm.

The base layer serving as the dielectric layer of the ink sheet was a 6μm thick polyester film. The conductive ink layer was formed as a 3.5μm thick layer of the above-mentioned conductive powder. Selected portions of the conductive ink layer of the ink sheet were transferred to a transfer medium by a thermal trancription image forming system.

Figure 11:
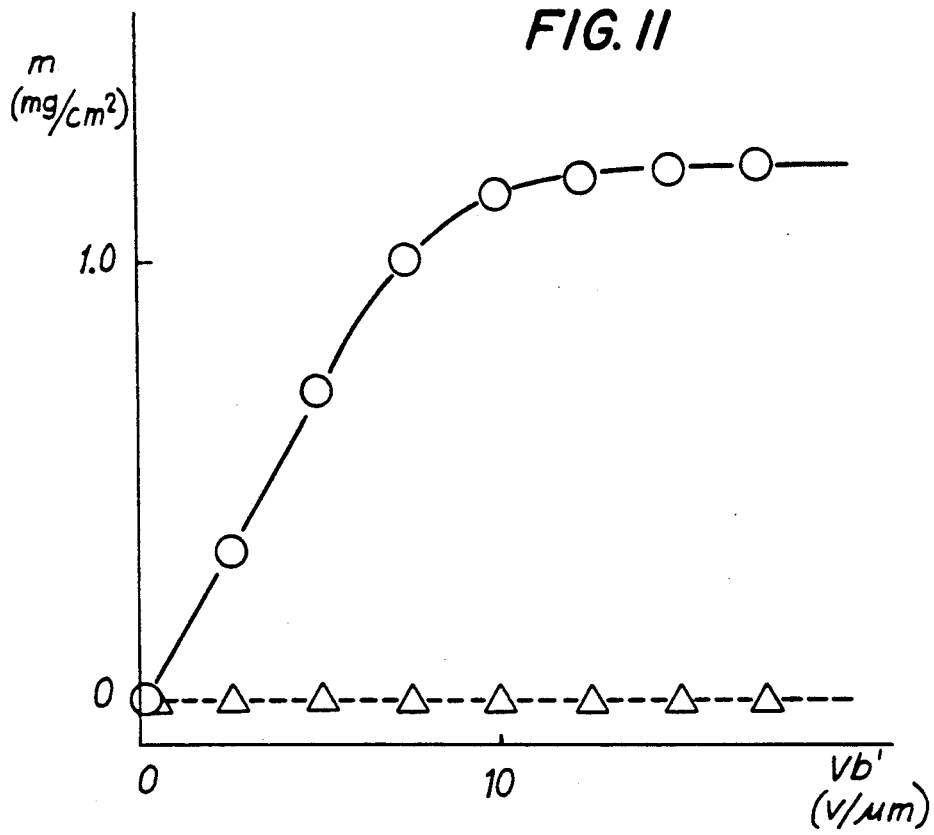
FIG. 11 is a graph illustrating the variation of ink adhesion with applied electric field.

FIG. 11 is a graph representing the results of this analysis. The abscissa indicates the bias voltage per thickness $V_b'$ and the ordinate indicates the adhesion quantity m of the conductive powder to the ink sheet. The symbol "O" and the solid connecting lines indicates data for the conductive powder adhered to depleted transcripted portions of the conductive ink layer of the ink sheet. The symbol "▲" and the broken connecting line indicates data for the conductive powder adhered to the non-printed portions of the conductive ink layer of the ink sheet.

FIG. 11 shows that adhesion of the conductive powder to the depleted transcription portions of the conductive ink layer of the ink sheet increases with an increase in bias electric field $V_b'$. The adhesion quantity is saturated and remain constant above about $V_b'=132V/\mu m$. As $V_b'$decreases below 13V/μm, the conductive powder gradually adheres less and less. The conductive powder is adhered in a nearly monolayer configuration at $V_b'=13V/\mu m$. Even when $V_b'>13V/\mu m$, the conductive powder is not adhered to a substantially greater degree than a single layer. If $V_b'$ is greater than 13V/μm, it is possible to make the adhesion quantity of the conductive powder constant. The adhesion quantity "m" of the conductive powder adhered to the non-recorded portion of the conductive ink layer of the ink sheet is not dependent on $V_b$ or $V_b'$ but remains at a constant setting such as: $m<0.02$ mg/cm$^2$ (less than 2% of the saturated adhesion quantity). This amount of adhesion virtually do not cause any problems. In the case of the configuration, of ink sheet 1" shown in FIG. 3, the bias voltage $V_b'$ at which adhesion quantity m exhibits a saturation point can be reduced below 13V/μm and 7V/μm may be suitable.

Figure 12:
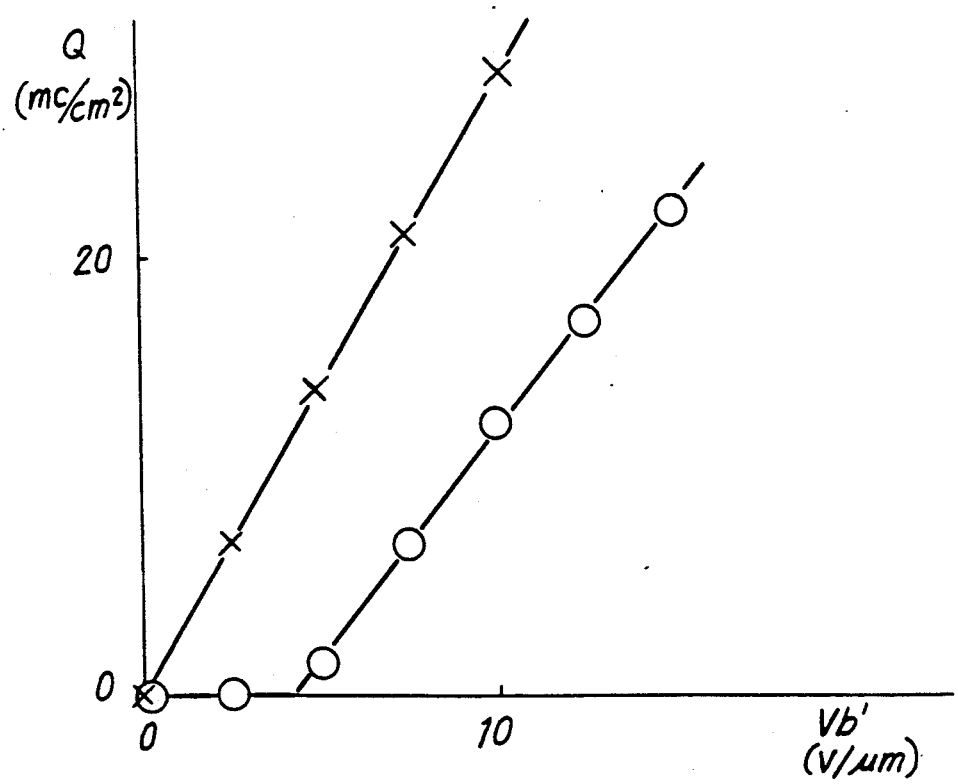
FIG. 12 is a graph illustrating the variation of charge density with applied voltage.

Experimental results have shown that there is a different relationship between a bias electric field $V_b'$ and the density of the applied electric charge "Q", the electric charge that the conductive powder carries, with respect to two kinds of ink sheets. FIG. 12 is a graph illustrating this phenomenon. The abscissa indicates bias electric field $V_b'$ and ordinate indicates density Q of the electric charge applied to the conductive powder. The symbol "O" represents data for the ink sheet depicted in FIG. 1, and the symbol "X" shows data for the ink sheet illustrated in FIG. 3. The data imply that the ease with which electric charge $-q$ is applied to a non-ink layer differs according to whether either the conductive layer or the dielectric layer is present.

When the dielectric layer is present as in FIG. 1, it is more difficult to apply electric charge $-q$ induced in electrode 12 to the dielectric layer (or alternatively, the dielectric polarization is difficult). Although not illustrated in the FIGURE, experimental results show that a graph showing the relationship between adhesion quantity m and density Q of the electric charge applied to the conductive powder would show that the adhesion quantity m is determined, not by a magnitude of $V_b$ ($V_b'$), but by the amount of electric charges applied to the conductive powder (i.e., applied electric charge density Q) from the fact that two would plots roughly coincide with each other.

It should be noted that the value of Q or the value of $V_b$ ($V_b'$) at which adhesion quantity m of the conductive powder exhibit saturation varies minutely depending on volume resistivity $\rho$ and the configuration of the conductive powder, and hence this result is not exactly true for all cases.

EXAMPLE 9

A conductive powder having inner core particle diameters of 6, 8 and 12μm were prepared as in Example 8 to examine, the effects of varying particle diameter and ink layer thickness. The same process of external addition of a coating as in the Example 8 was used on these inner core particles to prepare conductive powders. When measuring the volume resistivity of the conductive powder in connection with the pressure cell, all the conductive powders assume sufficient conductivity. These conductive powders are represented by s', t' and v', respectively. The conductive powders used in Example 8 is designated u'.

Conductive powders s', t', u' and v' were adhered to the depleted transcribed or void portions of the conductive ink layer of the ink sheets employed in Example 8 with the ink sheet reproducing method and apparatus depicted in FIG. 6 with $V_b'=15V/\mu m$ and $V_b=80V$.

The area ratio of the non-recorded portion to the recorded portion of the conductive ink layer was 1:1. The conductive powders adhered to the recorded portions of each conductive ink layer were fixed to the ink sheet by a heat roll fixing device to regenerate the ink sheet. Table 7 shows the relationship between film thickness (Di) of the conductive ink layer of the reproduced ink sheet and particle diameter of each conductive powder.

TABLE 7

| C | Di (μm) |
|---|---|
| s' | 3.1 |
| t' | 3.5 |
| u' | 3.9 |
| v' | 4.4 |
| ref. initial thickness | 3.5 |

C: Conductive Powder
Di: Film thickness

Table 7 and FIG. 11 show that the film thickness (Di) of the conductive ink layer can be controlled easily by regulating the particle diameter of the conductive powder and by regulating $V_b'$ (or Q). When $V_b'\geqq13V/\mu m$, the ink sheet was repeatedly reproduced with conductive powder t' so that the initial ink layer thickness of 3.5μm was invariably regenerated. When the mean particle diameter of the conductive powder is set to 8±0.5μm, the film thickness of the ink layer of the reproduced ink sheet can be controlled to 3.5±0.2 without problems arising.

EXAMPLE 10

Images were formed with an image forming system incorporating the ink sheet regenerating apparatus depicted in FIG. 9, with conductive powder t'. The ink sheet used had the configuration shown in FIG. 2. The base layer was a polyaramide film containing carbon black; the dielectric layer was a 3μm thick polyimide layer; and the conductive ink layer was a 3.5μm layer of conductive powder t'.

The thermal image forming device utilized the energization thermal transcription method. The apparatus for adhering the conductive powder utilized a method similar to that shown in FIG. 6 with $V_6'$ set at 10V/μm ($V_b$=30V). The powder was fixed to the ink sheet with a pressure fixing device.

The ink sheet was moved at a velocity of 2 cm/sec. The optical density (O.D. value) of a solid black portion exhibited values ranging from 1.45 to 1.48 even after 100 revolutions of the ink sheet when a sheet of bond paper was applied to the image forming portion. The lines produced also exhibited good reproducibility.

The ink sheet reproducing method and apparatus according to the invention is capable of forming well-conditioned images with no scattering in density and also no drop in the O.D. value with a continuously regenerated ink sheet. Only the depleted recorded portion of the ink layer is supplemented with additional conductive ink. Accordingly, a sharp decrease in the degree of scattering in the film thickness of the ink layer of the reproduced ink sheet is achieved, when compared to conventional ink sheet regeneration methods.

While not limited to the above-described embodiments, the ink sheet replenishment method according to the invention can provide the following:

(1) A method of reproducing an ink sheet in which transcription has been effected from a portion of an ink layer, including the steps of re-supplying conductive ink onto an ink sheet that includes at least such components as a dielectric layer and a conductive ink layer formed on the dielectric layer; and supplying conductive ink to supplement the transcripted portions of the ink layer. Consequently, the non-recorded portions of the ink layer are not supplemented with additional conductive ink. Accordingly, the replenished ink sheet is formed without rugged portions on the surface of the ink layer.

(2) A method of replenishing the ink layer of an ink sheet formed with at least a dielectric layer and conductive ink layer formed on the dielectric layer, in which transcription has been effected from a portion of the ink layer, including the steps of supplying conductive ink between the ink sheet and an electrode disposed at an interval from the ink layer and forming an electrically conductive path in the conductive replacement ink. Conductive ink only adheres to the transcribed portions of the ink layer of the ink sheet, thereby regenerating the ink sheet without rough portions on the surface of the ink layer.

(3) A method of replenishing the ink layer of an ink sheet formed with at least a dielectric layer and a conductive ink layer formed on the dielectric layer, in which transcription has been effected from a portion of the ink layer, including the steps of supplying conductive ink onto the ink sheet and imparting electric charges into the conductive ink in contact with the transcribed portions of the ink layer. Accordingly, the conductive ink can be selectively adhered to only the transcribed portions of the ink layer of the ink sheet, thereby reproducing the ink sheet formed without rough portions on the surface of the ink layer.

(4) A method of replenishing the ink layer of an ink sheet formed with at least a dielectric layer and a conductive ink layer formed on the dielectric layer, in which transcription has been effected from a portion of an ink layer including the steps of supplying conductive ink as a supplement to the transcribed portions of the ink layer wherein the conductive ink is classified as conductive powder. The conductive powder can be selectively adhered in a substantially monolayer configuration to only the transcribed portions of the ink layer, whereby the amount of adhesion of the conductive powder can be readily controlled both by regulating the voltage and by controlling the volume mean particle diameter of the conductive powder. This arrangement permits the regeneration of the ink sheet without rough portions on the surface of the ink layer.

(5) A method of replenishing the ink layer of an ink sheet formed with at least a dielectric layer and a conductive ink layer formed on the dielectric layer, in which transcription has been effected from a portion of an ink layer including a device for carrying the sheet; a device for storing conductive ink; a device for supplying the conductive ink onto the ink sheet; and a device for imparting electric charges into the conductive ink brought into contact with recorded portions of the ink layer. In this construction, the conductive ink can be selectively adhered to only the recorded portions of the ink layer, thereby replenishing the ink sheet without rough portions on the surface of the ink layer.

In accordance with the ink sheet replenishment method and apparatus of the invention, an ink sheet can be repeatedly used in a thermal transcription image forming system, resulting in a considerable reduction operating costs. Even after the ink sheet has been replenished many times, images are formed without deterioration in image qualities such as (maximum O.D. value, reproducibility of fine lines and color reproducibility).

Accordingly, the ink sheet reproducing method and apparatus according to the invention can be effectively included in an image forming system such as a printer, video printer, facsimile, copying machine and so on. Although the illustrative embodiments of the invention have been described in detail with reference to the accompanying drawings, it is to be understood that the invention is not limited to those precise embodiments. Various changes or modifications may be effected without departing from the scope or spirit of the invention.

It will thus be seen that the objects set forth above, among those made apparent from the preceding description, are efficiently attained and, since certain changes may be made in the carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Particularly it is to be understood that in said claims, ingredients or compounds recited in the singular are intended to include compatible mixtures of such ingredients wherever the sense permits.

What is claimed is:

1. An apparatus for replenishing the ink layer in an ink sheet including a layer of dielectric material and a layer of electrically conductive ink formed on the dielectric layer wherein portions of the ink layer have been removed during transcription to create depleted portions in the ink layer, comprising:

replacement ink supply means for holding and supplying electrically conductive replacement ink to the depleted portions of the ink layer;

charge supply means including ink supply electrode means for inducing an electric charge at the layer of dielectric material through the conductive replacement ink and base electrode means on the opposite side of the dielectric layer from the ink layer for inducing an opposite charge at the opposite side of the dielectric layer from the ink layer, whereby the replacement ink in contact with the depleted portions attaches thereto by electrostatic force due to the charge of opposite polarity induced at the opposite side of the dielectric layer; and removal means to remove replacement ink not adhering to the dielectric layer.

2. The apparatus for replenishing ink of claim 1, wherein the ink transfer sheet further includes a conductive supporting base layer disposed on the surface of the dielectric layer opposite to the ink layer.

3. The apparatus for replenishing ink of claim 1, wherein the replacement ink supply means includes a rotating first electrode portion spaced apart from the ink layer of the ink sheet and means to feed conductive ink to the depleted portions in the ink layer and establish a current path from the first electrode to the dielectric layer and the charge supply means includes voltage means for applying a bias voltage between the first electrode and the base electrode for generating charges in the replacement ink and opposite charges on the dielectric layer to attract the replacement ink to the depleted portions of the ink sheet.

4. The apparatus for replenishing ink of claim 3, wherein the replacement ink supply means further includes a multi-polar magnet on the first electrode portion for magnetically holding replacement ink to the first electrode portion.

5. The apparatus for replenishing ink of claim 1, wherein the electrode disposed on the opposite side of the ink sheet from the ink layer is in the form of a conductive layer on the dielectric layer.

6. The apparatus for replenishing ink of claim 1, wherein the ink sheet is for color printing and the ink layer includes a series of colored ink bands and the replacement ink supply means includes a series of colored ink supply sources corresponding to the colors of the ink sheet.

7. An apparatus for replenishing ink transferred from an ink layer of an ink transfer sheet including a conductive ink layer on a dielectric layer, comprising:

replacement ink supply means for supplying electrically conductive replacement ink to a depleted ink layer; and charge supply means for inducing an electric charge in the replacement ink supplied to the depleted ink layer and inducing an opposite charge at the side of the dielectric layer opposite the ink layer so that replacement ink from the supply means will be transferred electrostatically to depleted portions of the ink sheet.

8. The apparatus for replenishing ink of claim 7 wherein the ink transfer sheet includes a conductive supportive base disposed on the surface of the dielectric layer opposite to the ink layer.

9. The apparatus for replenishing ink of claim 7, wherein the replacement ink supply means includes a rotating first electrode spaced apart from the ink layer of the ink sheet and means to feed conductive ink to the depleted portions of the ink layer and establish a current path from the first electrode to the dielectric layer and the charge supply means includes voltage means for applying a bias voltage between the first electrode and the dielectric layer for generating charges in the replacement ink and opposite charges on the dielectric layer to attract replacement ink to the depleted portions of the ink sheet.

10. The apparatus for replenishing ink of claim 9, wherein the replacement ink supply means includes a multi-polar magnet disposed on the first electrode for holding replacement ink to the first electrode.

11. The apparatus for replenishing ink of claim 7, wherein the ink sheet is for color printing and the ink layer includes a series of colored ink bands and the replacement ink supply means includes a series of colored ink supply sources corresponding to the colors of the ink sheet.

12. An apparatus for replenishing ink transferred from a depleted ink layer of an ink transfer sheet including a conductive ink layer on a dielectric layer, comprising:

replacement ink supply means for magnetically holding electrically conductive replacement ink while supplying the ink to a depleted ink layer; and charge supply means for inducing an electric charge in the replacement ink supplied to a depleted ink layer and inducing an opposite charge on the opposite side of the dielectric layer of the ink sheet so that replacement ink from the supply means will be transferred electrostatically to depleted portions of the ink sheet.

13. The apparatus for replenishing ink of claim 12, wherein the ink supply means includes an electrode portion and a multi-polar magnet for magnetically holding the replacement ink to the electrode portion.

14. The apparatus for replenishing ink of claim 12, wherein the volume resistivity of the conductive ink layer is about $10^2 \Omega \cdot cm$ or less.

15. The apparatus for replenishing ink of claim 12, wherein the apparatus is constructed to apply a bias electric field to the ink sheet which is not less than 13 $V/\mu m$.

16. The apparatus for replenishing ink of claim 12, wherein the replacement ink is powdered ink having a mean particle diameter between 7.5 and 8.5 $\mu m$.

17. The apparatus for replenishing ink of claim 12, wherein the dielectric layer includes oxides and nitrides.

18. The apparatus for replenishing ink of claim 12, wherein the replacement ink includes electrification control agents.

19. The apparatus for replenishing ink of claim 12, wherein the replacement ink includes magnetic powder.

20. The apparatus for replenishing ink of claim 12, wherein the charge supply means includes a base electrode positioned to be at the ink sheet on the side of the ink sheet opposite the conductive ink layer, the base electrode having a charge opposite the charge of the ink layer.

21. The apparatus for replenishing ink of claim 12, including the ink transfer sheet which includes a conductive base layer disposed on the dielectric layer and the base layer and ink layer are on opposite sides of the dielectric layer.

22. The apparatus for replenishing ink of claim 20, wherein the replacement ink supply means includes a rotating first electrode portion spaced apart from the ink layer of the ink sheet and means to feed conductive ink to the depleted portions in the ink layer and establish a current path from the first electrode portion to the dielectric layer and the charge supply means includes voltage means for applying a bias voltage between the first electrode portion and the base electrode for generating charges in the replacement ink and opposite charges on the dielectric layer to attract the replacement ink to the depleted portions of the ink sheet.

23. The apparatus for replenishing ink of claim 22, wherein the ink supply means includes a multi-polar magnet for magnetically holding the replacement ink to the first electrode portion.

24. The apparatus for replenishing ink of claim 23, wherein the multi-polar magnet is inside of the first electrode portion.

25. The apparatus of replenishing ink of claim 23, wherein the first electrode portion is the multi-polar magnet.

26. The apparatus of replenishing ink of claim 23, wherein the multi-polar magnet is disposed on the first electrode portion.

27. The apparatus of replenishing ink of claim 22, wherein the apparatus is constructed to apply a bias electric field to the ink sheet which is not less than 7V/μm.

28. The apparatus of replenishing ink of claim 20, wherein the replacement ink is applied in the form of an ink powder.

29. The apparatus of replenishing ink of claim 28, including fixing means for fusing the ink powder to the ink sheet.

30. The apparatus of replenishing ink of claim 20, wherein the volume resistivity of replacement ink is about $10^6$ Ω·cm or less.

31. The apparatus of replenishing ink of claim 20, wherein the ink sheet is for color printing and the ink layer includes a series of colored ink bands and the replacement ink supply means includes a series of colored ink supply sources corresponding to the colors of the ink sheet.

* * * * *